United States Patent [19]

Matsumoto

[11] 4,269,610

[45] May 26, 1981

[54] ELECTROSTATIC PRECIPITATOR WITH SUPPLEMENTAL MEANS FOR CATCHING DUST RELEASED FROM THE MAIN COLLECTOR PLATES

[75] Inventor: Yoichi Matsumoto, Takasago, Japan

[73] Assignee: Metallgesellschaft Aktiengesellschaft, Frankfurt am Main, Fed. Rep. of Germany

[21] Appl. No.: 74,774

[22] Filed: Sep. 12, 1979

Related U.S. Application Data

[63] Continuation of Ser. No. 851,355, Nov. 14, 1977, abandoned.

[30] Foreign Application Priority Data

Nov. 12, 1976 [JP] Japan ..... 51-135438

[51] Int. Cl.[3] ..... B03C 3/47; B03C 3/76

[52] U.S. Cl. ..... 55/112; 55/114; 55/136; 55/146; 55/156; 55/424

[58] Field of Search ..... 55/112, 114, 136, 424, 55/428, 146, 156

[56] References Cited

U.S. PATENT DOCUMENTS

| | | | |
|---|---|---|---|
| 1,495,363 | 5/1924 | Weiskopf | 55/112 X |
| 1,551,724 | 9/1925 | Anderson | 55/112 X |
| 1,888,606 | 11/1932 | Nesbit | 55/13 |
| 2,625,238 | 1/1953 | Roper | 55/114 X |
| 3,633,337 | 1/1972 | Walker et al. | 55/112 X |
| 3,719,031 | 3/1973 | Gelfand | 55/136 |
| 3,985,524 | 10/1976 | Masuda | 55/112 |
| 3,988,130 | 10/1976 | Ramsey et al. | 55/112 |

FOREIGN PATENT DOCUMENTS

| | | | |
|---|---|---|---|
| 747301 | 4/1956 | United Kingdom | 55/112 |
| 519220 | 6/1976 | U.S.S.R. | 55/112 |

*Primary Examiner*—Kathleen J. Prunner
*Attorney, Agent, or Firm*—Karl F. Ross

[57] ABSTRACT

An electrostatic precipitator comprises a housing formed with the usual collector plates and a main bin below these plates into which the dust passes upon rapping of the plates. Dust which tends to be shifted toward the outlet upon discharge from the collector plates is caused to electrostatically adhere to supplemental charged surfaces downstream of the main collector plates and is released into a supplemental bin also located downstream of the main collector plates.

5 Claims, 3 Drawing Figures

ELECTROSTATIC PRECIPITATOR WITH SUPPLEMENTAL MEANS FOR CATCHING DUST RELEASED FROM THE MAIN COLLECTOR PLATES

This is a continuation application of Ser. No. 851,355, filed Nov. 14, 1977 and now abandoned.

FIELD OF THE INVENTION

The present invention relates to an electrostatic precipitator and, more particularly, to an electrostatic dust collector having means for preventing dust from being swept to the outlet upon release from the main collector plates.

BACKGROUND OF THE INVENTION

An electrostatic precipitator for the removal of particles from a gas stream, i.e. for the removal of dust from a gas stream entraining same, generally comprises a housing which is traversed by the gas stream from an inlet side thereof to an outlet disposed opposite the inlet side. Within this housing, there are provided mutually spaced and parallel, generally vertical, collecting plates which may be interleaved with arrays of corona discharge electrodes spaced from these plates.

Below these collector plates there is provided a bin into which dust adhering to the collector plates is discharged when the collector plates are jolted, rapped or otherwise agitated to release the adherent dust.

The particles contained in the gas stream are electrostatically charged by the corona electrodes and are attracted to the oppositely charged collector surfaces upon which they accumulate in a layer which is dislodged by the rapping operation. The gas is thus freed from the particles and passes through the outlet in a relatively pure state.

When the collector surfaces are de-energized and/or rapped in the manner described, the dust of the collected layers breaks up into flakes and particles as it falls into the bin.

While most of the solids are thus collected in the bin which can be emptied from time to time, some of the particles are of a sufficiently small size to float freely above the bin and can be entrained by the gas stream toward the outlet. These latter particles, therefore, recontaminate the gas stream and the entrainment thereof reduces the separation efficiency of the precipitator.

OBJECTS OF THE INVENTION

It is the principal object of the present invention to provide an electrostatic precipitator which has improved efficiency and a reduced tendency for re-entrainment of previously deposited dust.

Another object of the invention is to provide an improved electrostatic precipitator which avoids the disadvantages set forth previously.

Yet another object of the invention is to maintain the high efficiency of separation of solids from an entraining gas stream which is brought about by electrostatic precipitation, by eliminating or reducing the tendency for previously collected particles to be entrained to the outlet of the apparatus.

SUMMARY OF THE INVENTION

These objects and others which will become apparent hereinafter are attained, in accordance with the present invention, in an electrostatic precipitator which is provided, between the main collector plates described above and the main bin, and the outlet of the apparatus from which the gas emerges, with an auxiliary or supplemental collector surface which is electrostatically charged and is juxtaposed with corona-discharge electrode means so that any re-entrained particles are caused to electrostatically deposit upon this supplemental surface.

According to an important feature of the invention, the supplemental collector surface is formed as the floor of the flow path on the outlet side of the array of main collector electrodes within the electrostatic precipitator housing and a supplemental or auxiliary collecting hopper is provided beneath this collector surface.

Investigations have shown that the dust which is re-entrained and fluidized by the gas stream upon discharge from the main collector electrodes is located substantially only at the lower portion of the gas stream horizontally traversing the precipitator housing. This portion of the gas stream runs directly along the lower wall or floor of the outlet side of the apparatus which may provide a cross-sectional reduction in the flow path from the array of main collector electrodes to the outlet duct. Because of this reduction of flow-cross-section, there is an increase in the gas velocity which may account in large measure for the re-entrainment of the particles cascading into the main hopper.

When this lower surface or floor of the outlet side of the housing is provided as an electrostatically charged supplemental collector electrode, surprisingly, practically all re-entrained dust is recaptured despite the fact that this surface is only exposed to a very small fraction of the gas stream exiting from the apparatus.

According to a feature of the invention, the supplemental collector surface is formed as a plurality of swingable partial surfaces or flaps which can be pivoted about respective horizontal axes and can be swung downwardly to discharge any dust collected thereon into the supplemental hopper opening below this array of flaps. In their downwardly swung positions, the flaps can engage a rapping means which helps shed the collected dust.

In another embodiment of the invention, the supplemental collector surface is formed with one or more openings through which the dust can be passed into the supplemental hopper and a mechanical cleaning device, e.g. a scraper or a wiper is provided to carry the collected dust to this opening from which it cascades into the supplemental hopper therebelow.

The corona electrode means juxtaposed with the supplemental collector can comprise conventional corona electrode wires or strips spanning a support frame which lies parallel to the supplemental collector and is mounted in the outlet of the housing via electric insulators.

When, in the apparatus of the present invention, the main collector electrodes are rapped to dislodge the dust therefrom, the major part of the dust falls directly into the main dust-collecting hopper. A small portion of the dust is, however, fluidized by the gas stream and entrained toward the outlet where it is reprecipitated in the manner described. Thus, during the portions of the operating cycle in which the main collector electrodes are cleared of dust, re-entrained dust is not carried off with the gas stream. While the swingable flap auxiliary collector electrode has the significant advantage that the cleaning takes place out of the path of the gas stream and hence that re-entrainment from the supplemental and collector surface is excluded, the same cannot be said for the embodiment in which the supplemental collector is provided with openings as described. The latter embodiment is, however, less expensive than the swingable flap arrangement.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
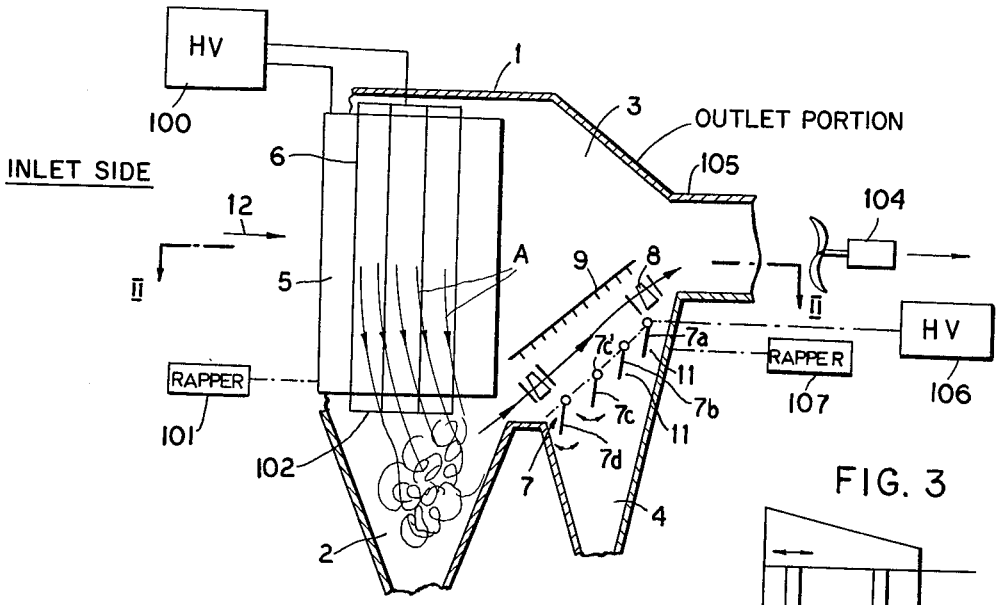
FIG. 1 is a diagrammatic vertical cross-section of a portion of an electrostatic precipitator embodying the invention.
Figure 2:
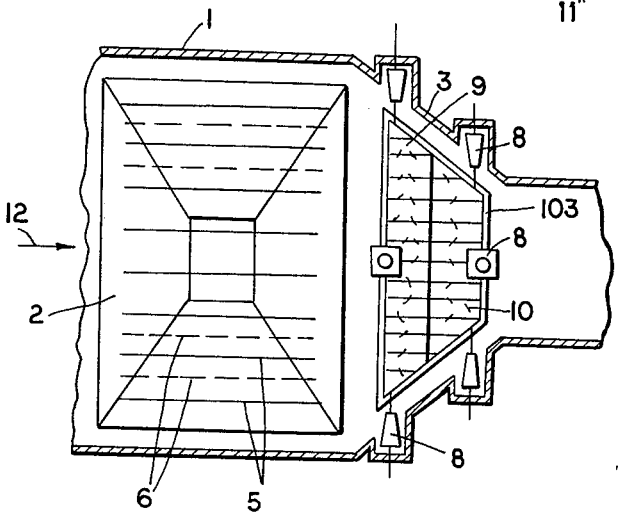
FIG. 2 is a section taken along the line II—II of FIG. 1.

FIGS. 1 and 2 show, greatly simplified and with many structural elements unimportant to the principles of the invention omitted, an electrostatic precipitator. The electrostatic precipitator comprises a housing 1 which is supplied with a particulate-laden gas in the direction of arrow 12 from the left or inlet side of the apparatus. In the main body of the housing, there is provided a multiplicity of vertical plate-like collector electrode sheets 5 which are interleaved with respective arrays of corona discharge electrodes 6 in the usual manner. Below the main collector electrodes 5, there is provided the usual main hopper 2 in which the dust discharged from the collector electrodes 5 is collected. The collector electrodes 5 are provided wth rappers represented diagrammatically at 101 and are connected to one pole of a high-voltage direct-current source 100, the other pole of which is connected to the corona electrodes 6 supported by a frame 102.

Downstream of the hopper 2, there is provided a supplemental or auxiliary hopper 4 below the bottom of the outlet portion 3 of the housing 1.

The substantially horizontal gas stream 12 enters the apparatus as shown from the left and passes through the electric field generated between the corona electrodes and the collector electrodes. In this region of the precipitator, in which the flow cross-section is greatly enlarged so that the gas velocity falls sharply, the charged particles are attracted to the collector electrodes and are separated from the gas stream with high efficiency.

After leaving this electric field region, however, the gas velocity increases as a result of the progressive reduction of the flow cross-section.

When sufficient dust has collected upon the electrodes 5, the latter are rapped and the dust descends by gravity (arrows A in FIG. 1) into the hopper 2. However, a portion of the dust is fluidized and re-entrained by the gas stream before it fully enters the hopper as a result of the increasing velocity of the gas. The re-entrained solids are concentrated along the lower part of the outlet portion 3 of the housing 1 which can communicate with a duct 105 provided with a blower 104 for inducing the flow of gas through the apparatus.

According to the present invention, the outlet portion 3 of the apparatus is provided with a supplemental collector electrode 7 which forms the lower surface of the outlet portion and is juxtaposed with a corona electrode array 9 disposed thereabove. The supplemental corona electrode assembly and collector electrode surface are disposed so that practically all of that portion of the gas which re-entrains the dust, passes between them.

The corona electrode 9 is connected to one pole of a high-voltage direct-current source 106 while the other pole of the latter is connected to the collector electrode means 7 so that this re-entrained dust is attracted to the collector electrode 7 and is recovered from the gas. At the outlet duct 105, therefore, the gas is practically free from dust.

The dust deposited upon the supplemental collector 7 is discharged from time to time. To this end the supplemental collector can be formed, as seen in FIG. 1, as downwardly swingable flaps *7a–7d* which are pivoted at *7c'*, for example, about horizontal axes. The flaps can assume an orientation in which they are practically coplanar as represented by the dot-dash line through the respective axes. In their downwardly swung positions, the flaps can engage bars 11 connected to a rapper 107 to promote release of the dust. The dust so discharged passes downwardly through the vertical channels formed between the flaps and is, therefore, not re-entrained by the gas.

As can be seen in greater detail from FIG. 2, the corona electrode 9 comprises the usual frame 103 spanned by the corona electrode wires 10 and supported in insulators 8 in the outlet 3 of the housing.

Figure 3:
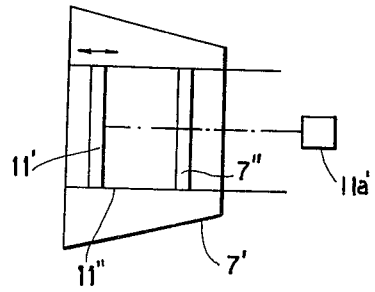
FIG. 3 is a partial plan view illustrating another embodiment of the invention.

FIG. 3 shows that the auxiliary collector 7' may be a plate provided with openings, one of which is shown at 7'', communicating with the hopper 4 therebelow. In this case, the means for discharging the dust can include a scraper or wiper 11' guided at 11'' and shifted by a drive 11a' to conduct the dust to the opening 7''.

I claim:

1. An electrostatic precipitator comprising:

a housing having an inlet side and an outlet portion horizontally spaced from said inlet side and traversed by a horizontal stream of gas entraining particles into said inlet side;

an array of main collector electrodes between said inlet side and said outlet portion in said housing and a plurality of arrays of main corona discharge electrodes in said housing for charging said particles, said main collector electrodes being vertical plates interleaved with said arrays of main corona discharge electrodes and being provided with rappers whereby said particles are deposited upon said main collector electrodes and are intermittently dislodged downwardly therefrom;

a main hopper formed on said housing directly below said main collector electrodes and arrays of main corona electrodes and opening upwardly toward said arrays of main electrodes in said housing for receiving particles dislodged from said main collector electrodes, said main hopper being upstream of said outlet portion, said outlet portion having a progressively decreasing flow cross section away from said main collector electrodes, said outlet portion having a floor inclined upwardly in the direction of flow of said stream;

an auxiliary hopper formed on said housing below said outlet portion and downstream of said main hopper, said auxiliary hopper communicating with the interior of said outlet portion through said upwardly inclined floor;

an auxiliary charged collector disposed above said auxiliary hopper along the bottom of said outlet portion and forming said upwardly inclined floor over said auxiliary hopper for collecting particles re-entrained by said gas and depositing same in said auxiliary hopper, said collector thereby being inclined upwardly in the direction of flow of the gas, said auxiliary collector being formed by a plurality of swingable flaps;

means for dislodging particles from said auxiliary collector and causing them to fall into said auxiliary hopper; and auxiliary corona discharge electrode means spaced above said auxiliary collector in said outlet portion for charging re-entrained particles and enabling their attraction to said auxiliary collector, the auxiliary electrode means being spaced from the arrays of main corona electrodes and being disposed so that particles entrained by gas out of said main hopper pass between said auxiliary electrode means and said auxiliary collector.

2. The electrostatic precipitator defined in claim 1 wherein said swingable flaps are swingable about respective horizontal axes.

3. The electrostatic precipitator defined in claim 2, said means for dislodging particles from said auxiliary collector comprising rapping means engageable with said flaps in downwardly swung positions thereof to dislodge particles from said flaps.

4. The electrostatic precipitator defined in claim 1 wherein said auxiliary corona discharge electrode means includes a frame mounted on insulators in said outlet portion and spanned by respective auxiliary corona discharge electrodes.

5. The electrostatic precipitator defined in claim 4 wherein said frame lies in a plane inclined upwardly in the direction of flow of said gas through said outlet portion.

* * * * *